United States Patent [19]

Reeve et al.

[11] Patent Number: 4,700,851

[45] Date of Patent: Oct. 20, 1987

[54] LIGHTWEIGHT, SELF-POWERED, TRANSPORTABLE CRANE ASSEMBLY

[76] Inventors: Richard J. Reeve; George I. Noah, both of 5250 D Highway 50 East, Carson City, Nev. 89701

[21] Appl. No.: 724,563

[22] Filed: Apr. 18, 1985

[51] Int. Cl.[4] ..... B66C 23/44; B66C 23/26; B66C 23/06; B66C 23/78

[52] U.S. Cl. ..... 212/181; 212/175; 212/179; 212/180; 212/189; 212/182; 212/187; 212/188; 212/195; 212/232; 212/238; 212/246; 212/261

[58] Field of Search ..... 212/175, 178, 179–182, 212/189, 195, 188

[56] References Cited

U.S. PATENT DOCUMENTS

| | | | |
|---|---|---|---|
| 885,803 | 4/1908 | Terry | 212/188 |
| 2,828,867 | 4/1958 | Frisk | 212/188 |
| 3,235,097 | 2/1966 | Ohman | 212/188 |
| 4,068,762 | 1/1978 | Kennard, Jr. et al. | 212/188 |
| 4,273,244 | 6/1981 | Jensen et al. | 212/189 |
| 4,508,233 | 4/1985 | Helms | 212/189 |

FOREIGN PATENT DOCUMENTS

| | | | |
|---|---|---|---|
| 1021150 | 12/1957 | Fed. Rep. of Germany | 212/189 |
| 2310525 | 9/1974 | Fed. Rep. of Germany | 212/189 |
| 2834811 | 2/1980 | Fed. Rep. of Germany | 212/189 |
| 2509708 | 1/1983 | France | 212/189 |
| 308381 | 2/1969 | Sweden | 212/189 |

*Primary Examiner*—Joseph F. Peters, Jr.
*Assistant Examiner*—R. B. Johnson
*Attorney, Agent, or Firm*—Robert B. Chickering; Glen R. Grunewald

[57] ABSTRACT

A lightweight, self-powered, transportable crane assembly is disclosed which includes a frame that can be selectively coupled to and uncoupled from the bed of a transport vehicle or carrier, such as a pick-up truck or trailer. The frame assembly also includes stabilizing legs which can be extended laterally from the frame assembly to stabilize the crane during use and further to allow the crane assembly to be self supporting apart from the truck or trailer. The crane assembly also can be coupled to a ballast structure such as a water tank or the like, to permit its use apart from the transport vehicle.

4 Claims, 10 Drawing Figures

LIGHTWEIGHT, SELF-POWERED, TRANSPORTABLE CRANE ASSEMBLY

BACKGROUND OF THE INVENTION

The present invention relates, in general, to crane assemblies, and more particularly, relates to a vehicle mounted crane assembly of the type which can be used in small or medium sized construction projects.

Residential and light industrial building contractors are often met with the need for a lightweight, easily transportable crane. Such a crane is not normally required throughout the building project, but there are many lifting jobs, such as the lifting of heavy beams, structural components and equipment, which are facilitated by, or absolutely require, a crane.

Presently, contractors typically satisfy this need by renting relatively large crane assemblies which are permanently mounted on a truck and can be brought to the job site to perform the various lifting tasks. Since the rental of such equipment is expensive, the contractor must carefully plan the critical path of construction which will minimize the number of days during which the crane is at the building site. Even with the best of planning, there will often be situations in which the crane either must be at the site and not in use, or taken away from the site and then returned at a later date. Both approaches add undesirably to the cost of using such equipment and tend to make its use relatively inconvenient. Moreover, often borderline jobs are attempted with inadequate lifting equipment in order to try to avoid the necessity of using crane time or returning the crane to the site.

Generally speaking the cost of conventional truck mounted cranes is so substantial that small or medium size contractors do not own such equipment themselves. Additionally, such truck mounted cranes often are of a size which require special permits to transport the same over city streets in urban areas. Alternatively, such cranes often include lifting booms that are segmented and must be taken apart and then reassembled at the site in order to enable transport on city streets.

Another alternative is to employ an extremely large crane which can be brought to the building site in sections and assembled or erected on the site. Such cranes remain in place throughout the building process, and accordingly are expensive and not used for smaller jobs.

OBJECTS AND SUMMARY OF THE INVENTION

A. Objects of the Invention

Accordingly, it is an object of the present invention to provide a lightweight, self-powered transportable crane assembly which can be mounted to a conventional transport vehicle, such as a pick-up truck or a trailer, and transported to a building site for use of the crane, either while mounted on the vehicle or mounted to a ballast structure.

Another object of the present invention is to provide a portable crane assembly which can be removably mounted to a vehicle for transport of the assembly to and from building sites or the like and yet can be removed or unmounted from the truck or trailer at the building site to free the transport vehicle for other tasks.

Still a further object of the present invention is to provide a lightweight, self-powered crane assembly which can be transported on city streets in urban areas by a conventional vehicle without the need for special permits.

Still a further object of the present invention is to provide a crane assembly which is transportable on a relatively small vehicle and yet employs the weight of the vehicle as a ballast to enable lifting of substantial weights by means of a boom having a significant span.

Another object of the present invention is to provide a crane assembly which is portable and can be coupled to structures conventionally present or required at building sites, such as a water tank, so as to use the weight of the structure as a counter balance in combination with a crane stabilizing support structure to enable the lifting of large weights.

Another object of the present invention is to provide a lightweight, self-powered transportable crane assembly which is durable, can be used with a variety of different transport vehicles, is relatively inexpensive to construct, is easy to deploy at the building site, is self-supporting to permit storage, loading and unloading, and is relatively inexpensive to manufacture.

B. Summary of the Invention

The lightweight, self-powered transportable crane assembly of the present invention includes a frame, a lifting boom movably mounted to the frame and formed to extend away therefrom, movable cable means carried by the boom and drive means coupled to extend and retract the cable means. In the improved crane assembly of the present invention the frame is relatively lightweight and is removably mounted to the bed of the transport vehicle in an orientation for operation of the crane assembly as mounted on the vehicle. Coupling means is provided to releasably secure the frame to the vehicle bed, and support means is carried by the frame and formed for movement into and out of engagement with a support surface proximate the crane assembly to stabilize the crane assembly as mounted to the vehicle.

In one aspect of the improved crane assembly the support means is formed for stand-alone support of the crane assembly apart from the vehicle in a position and orientation allowing the vehicle to be uncoupled from and driven away from the crane assembly or driven up to and coupled to carry the crane assembly. In another aspect of the present invention, the improved crane assembly includes coupling means, frame means and support means which are cooperatively formed to mount the crane to a selected one of the vehicle and a ballast structure so that the weight of the vehicle or ballast structure acts as a counter balance to the weight lifted by the crane assembly.

DESCRIPTION OF THE PREFERRED EMBODIMENT

The crane assembly of the present invention is constructed with a lightweight frame preferably having a size which will allow it to be mounted in the cargo bay of a relatively small truck, for example, a three quarter-ton pick-up truck. This lightweight construction and the demountable nature of the crane assembly allows the contractor to use the truck for transport and operation of the crane assembly, but additionally, allows the contractor to remove the crane assembly from the truck and use the truck as a general purpose vehicle. Thus, instead of buying a special vehicle with a crane permanently mounted on the vehicle, the crane assembly of the present invention can be purchased apart from the vehicle and used together with the contractor's truck to provide a system having greatly improved versatility for a much lower cost.

Figures 1, 2:
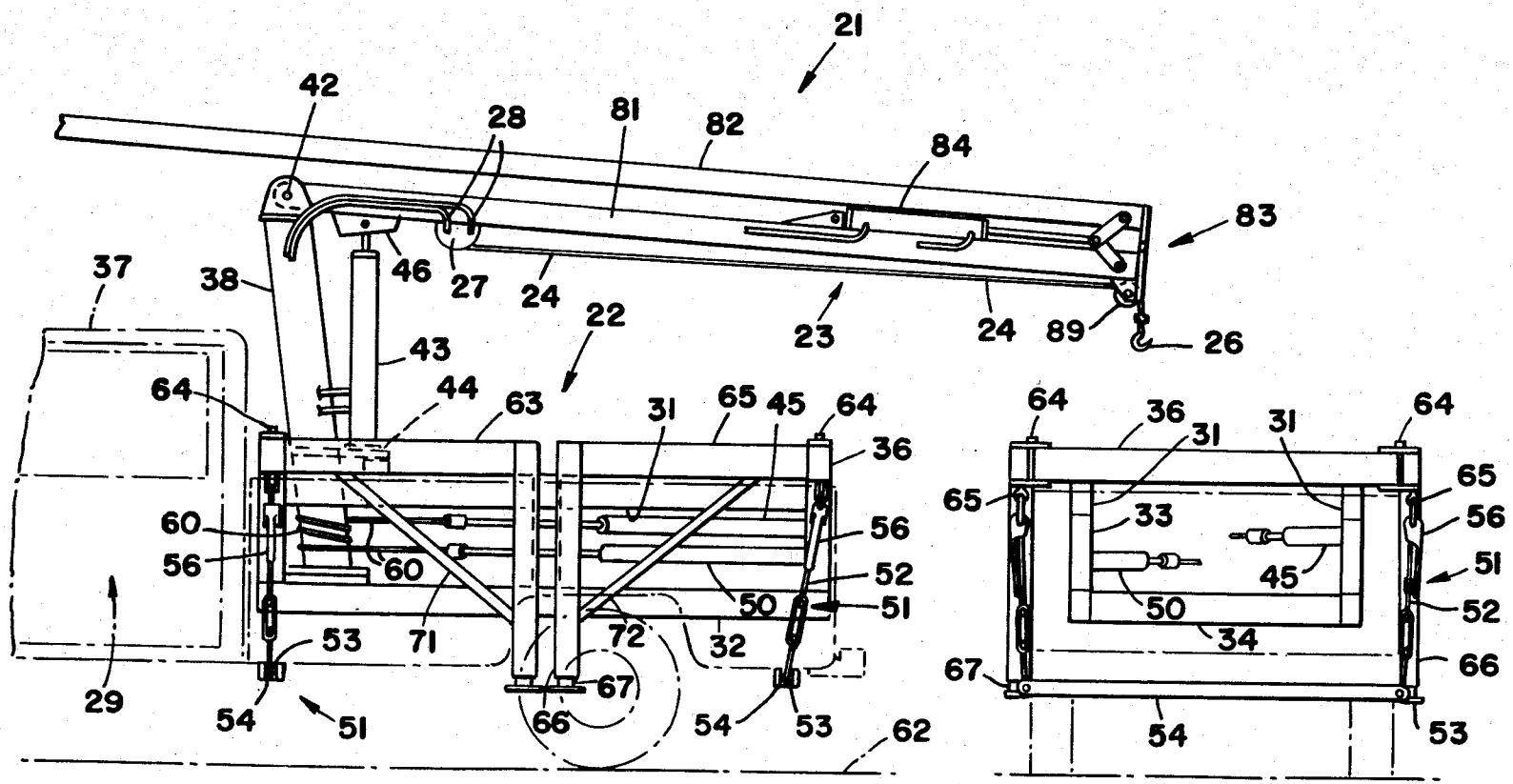
FIG. 1 is a fragmentary, side-elevation view of a crane assembly constructed in accordance with the present invention and shown mounted on a pick-up truck.
FIG. 2 is an end elevation view of the crane assembly of FIG. 1 shown without the boom or mast for simplicity of illustration.
Figure 3:
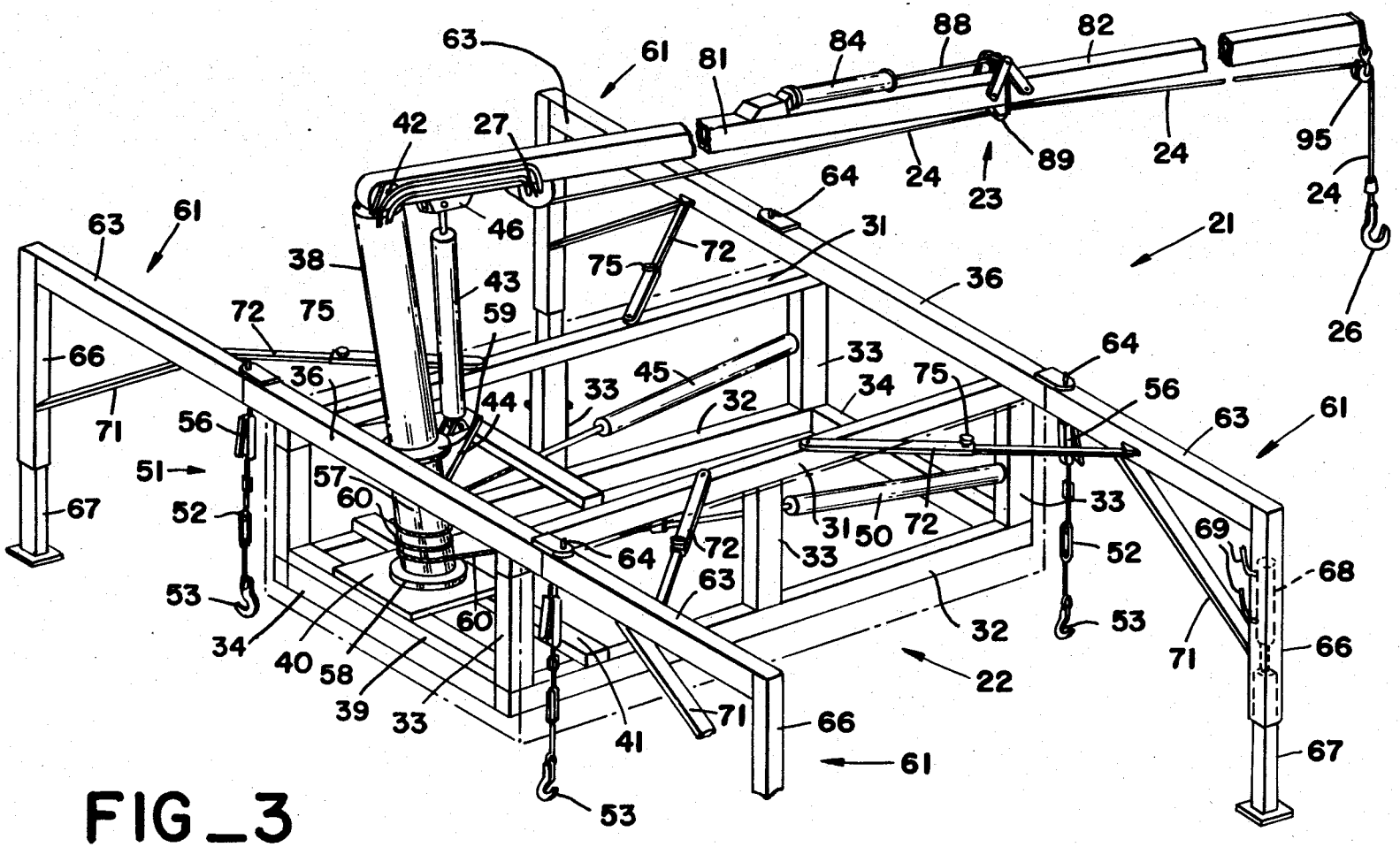
FIG. 3 is a top perspective view showing the self-supporting frame structure of the crane assembly of the present invention apart from the transport vehicle.
Figure 4:
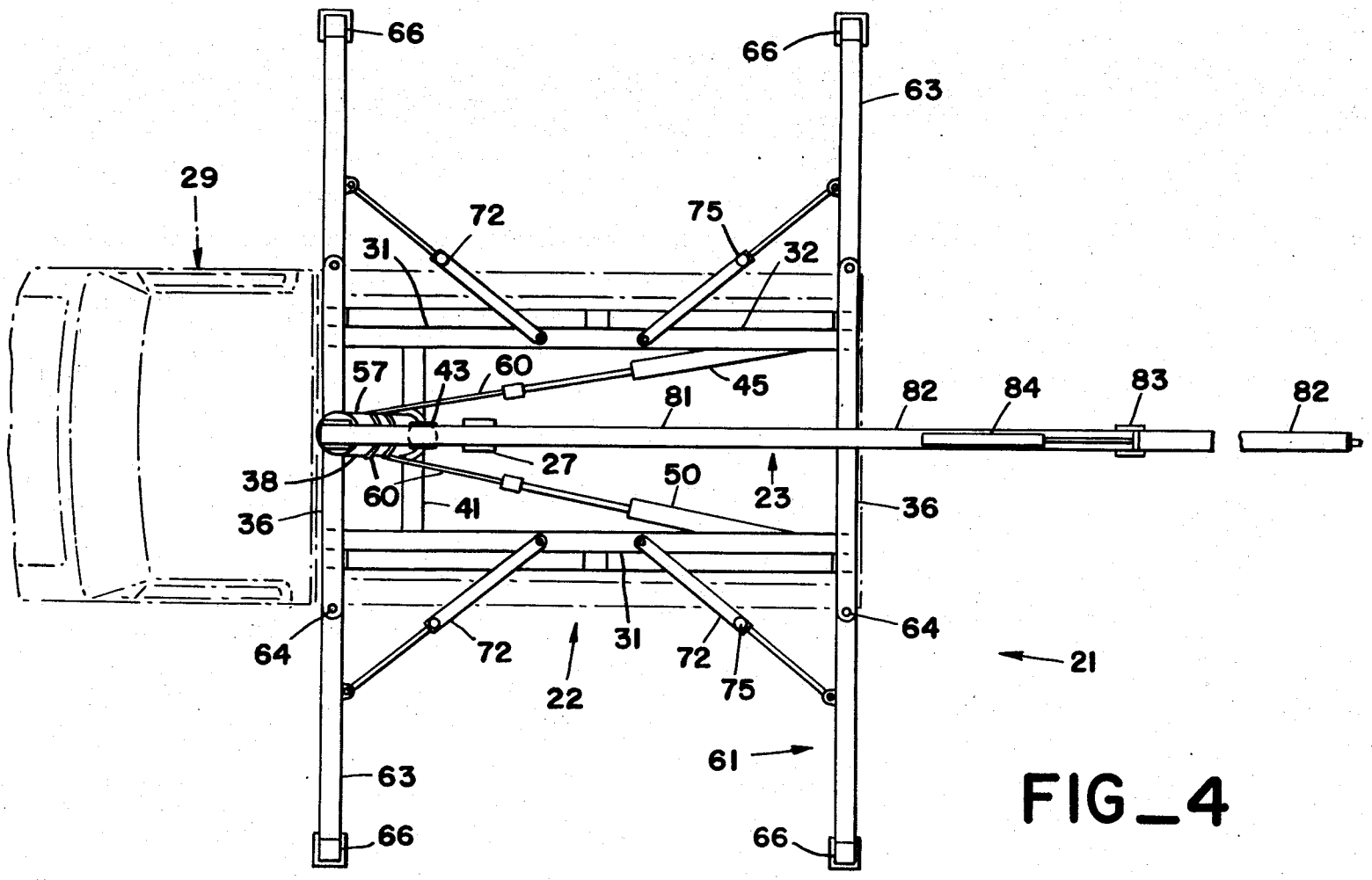
FIG. 4 is a top plan view of the crane assembly of FIG. 1 with the stabilizing support structure in a deployed position.

Referring to FIGS. 1 and 3, the crane assembly of the present invention, generally designated 21, can be seen to include a frame, generally designated 22, a lifting boom 23 movably mounted to frame 22 and formed to extend away therefrom in a manner which will be described hereinafter in more detail. Carried by boom 23 is a cable assembly, which can include cable 24 and lifting hook 26. In the form of the invention shown in the drawing, movable cable 24 is coupled to drive means 27 in the form of a hydraulically operated winch mounted directly on boom 23 and coupled through hydraulic lines 28 to a central hydraulic pump (not shown) for the crane assembly. Drive winch 27, therefore, is formed to extend to retract cable 24 along the length of boom 23 so as to enable lifting of objects from the boom.

In the improved crane assembly of the present invention, frame means 22 is formed as a relatively lightweight frame which can be removably mounted to the bed of a transport vehicle, such as pick-up truck 29. As best may be seen in FIG. 3, frame 22 is formed as a box-like assembly which can be mounted in the bed or cargo bay of the pick-up truck. Thus, the frame includes upper and lower longitudinally extending side frame members 31 and 32 which are connected together by vertical posts 33. Coupling the side frame assemblies together are horizontally extending upper and lower transverse beams 34 and 36 at both ends of the side frame assemblies.

In order to position boom 23 at an elevation above the top of the truck cab 37 of the truck assembly, it is preferable that a mast 38 be mounted to extend vertically from frame members 39 and 41 and mast mounting plate 40 to a position above cab top 37. Boom 23 is pivoted about pivot pin 42 on the top of mast 38 so that hydraulic cylinder 43, mounted between upper mounting plate 44 and bracket 46 on the boom can be used to raise and lower the boom. Rotation of boom 23 is accomplished by a pair of hydraulic cylinders 45 and 50 which are coupled to a cable 60 wrapped around a lower section 57 of mast 38. As cylinders 45 and 50 are displaced (one inwardly and the other outwardly), cable 60 causes rotation of mast 38 inside mounting collars 58 and 59 and boom 23 is accordingly rotated.

In order to releasably couple frame 22 to vehicle 29, the crane assembly of the present invention preferably includes coupling means, generally designated 51, which can advantageously take the form of a cable assembly 52 having a hook 53 mounted to one end and formed to be secured to transversely extending vehicle engaging bars 54 (FIGS. 1 and 2). The coupling assembly further includes a cable cinching mechanism 56, which in turn is coupled, for example, by an eye bolt 65 (FIG. 2) to transverse frame beams 36.

Securement of the frame to vehicle 29 can easily be accomplished by positioning transverse coupling bars 54 underneath the cargo bay of the vehicle. The cinching mechanism 56 can then be used to pull the bars up firmly against the underneath frame structure of the vehicle so that the bars 54 and cable assemblies 52 cause the frame to be clamped to the bed or cargo bay of the vehicle. This clamping action couples the frame of the crane assembly to the frame of the vehicle so that the entire weight of the vehicle can be used as ballast and a counterbalance to weight lifted by the crane, in a manner which will be described more fully hereinafter.

The improved crane assembly of the present invention further includes support means, generally designated 61, carried by frame 22 and formed for movement into and out of engagement with a support surface, 62, usually the ground on which the vehicle is supported. Support means 61 is formed to stabilize the crane assembly as mounted in the vehicle. This is preferably accomplished by providing transversely extending arms 63 which are pivoted at 64 about a vertical axis to frame beams 36 and which carry downwardly depending leg assemblies 66. In order to enable leg assemblies 66 to accommodate various heights and irregularities in support surface 62, each of the leg assemblies preferably include a telescopically mounted member 67 which is driven by a hydraulic cylinder 68 (FIG. 3) through hydraulic lines 69 from the central hydraulic pump of the crane assembly. Leg assemblies 66 further include reinforcing struts 71 and stabilizing link assemblies 72. The links 72 are comprised of two telescoping members and a locking pin 75 which can be manually positioned in openings which become aligned when the legs are fully extended.

The lightweight frame of the crane assembly of the present invention, therefore, is also suitable for stand-alone support of the crane assembly apart from the vehicle 29. The support means 61 can be pivoted to the outwardly extended position as shown in FIG. 3, and the leg members 67 hydraulically displaced down into contact with support surface 62. The coupling bars 54 can be removed to uncouple the crane assembly frame from the vehicle frame, and the legs displaced down further to lift frame 22 of the crane assembly up a sufficient distance to allow the truck to be driven out from under the crane. This is extremely important in that the vehicle is now available for use by the contractor while the crane can be stored, either at the contractor's facility or the construction site. Such stand-alone support of the crane assembly can also be used as a step in mounting the assembly to a ballast means or ballast structure of the type which is often available at a construction site.

Figure 5:
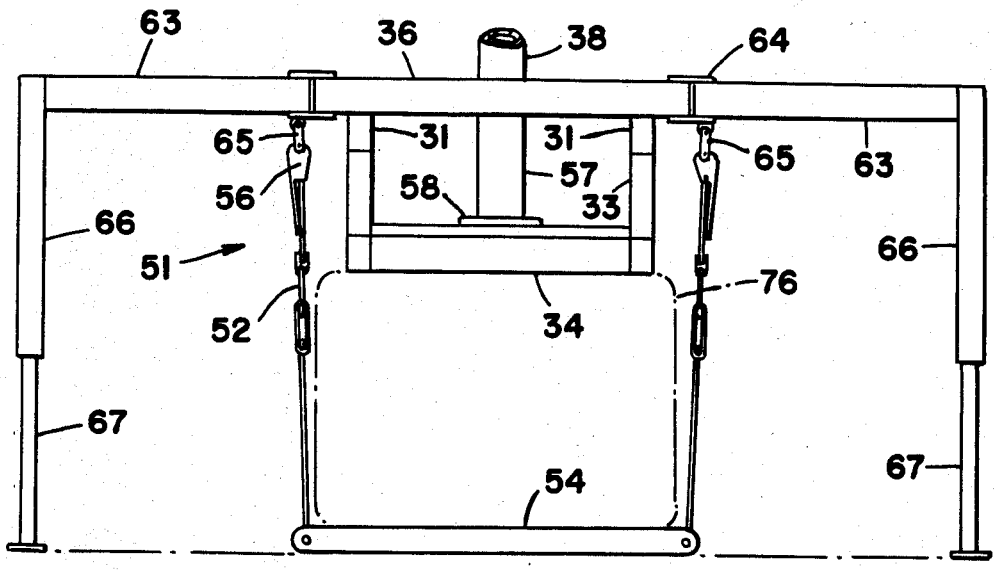
FIG. 5 is a fragmentary, end elevation view corresponding to FIG. 4 with the crane assembly shown mounted on a water tank ballast structure.
Figure 6:
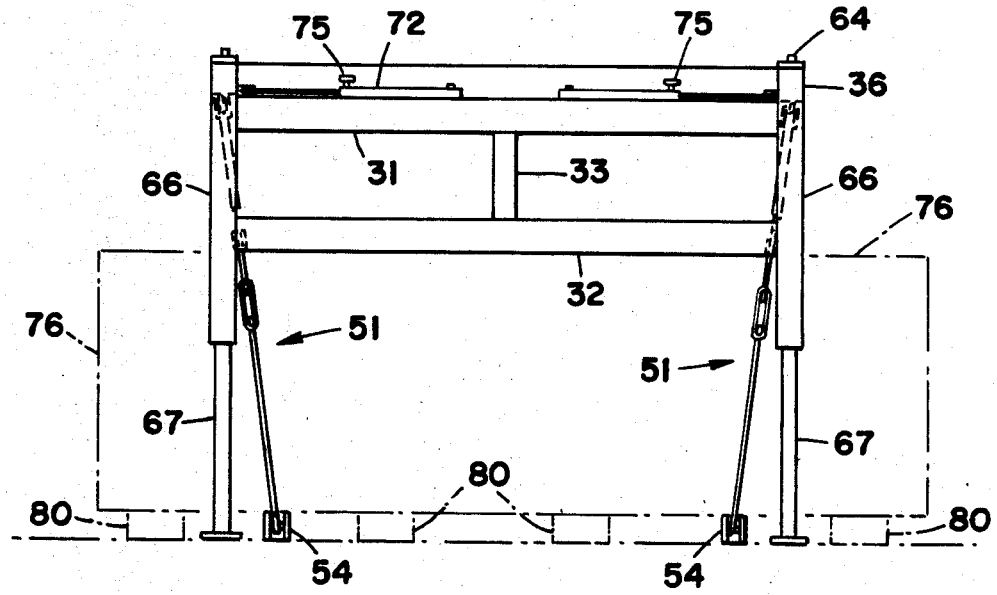
FIG. 6 is a side elevation view of the crane assembly of FIG. 5.

More particularly, once crane assembly 21 is lifted up off of vehicle 29 for stand-alone self-support of the crane apart from the vehicle, a ballast structure such as a water tank, can be positioned under the crane. Trailer or dolly mounted water tanks can be rolled under frame 22 and placed on dunnage 80 (FIG. 6). As best may be seen in FIGS. 5 and 6, coupling bars 54 can be used to couple frame 22 of the crane assembly to water tank 76. Coupling means 51 can then be used to couple bars 54 underneath the tank 76 between dunnage members 80, and the weight of water in the tank used as a ballast for the crane assembly.

Figure 9:
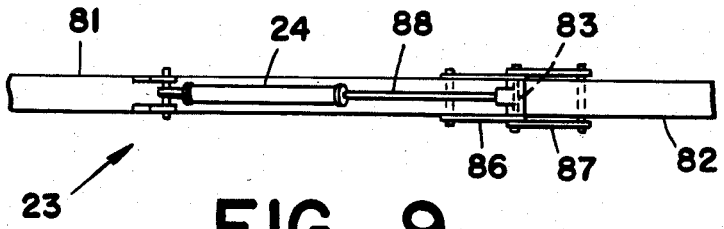
FIG. 9 is a fragmentary, top plan view of the crane boom corresponding to FIG. 8.
Figure 8:
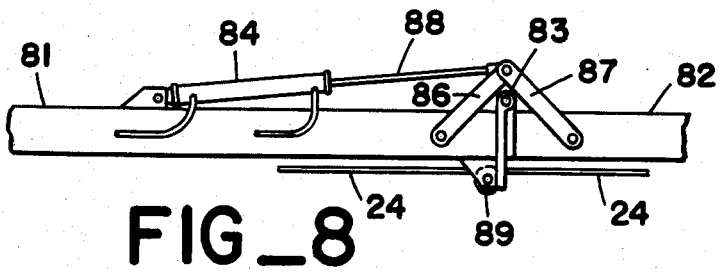
FIG. 8 is a fragmentary, side-elevation view corresponding to FIG. 7 with the boom in an extended position.
Figure 7:
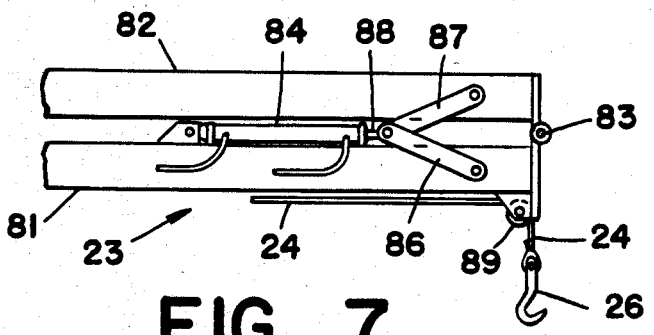
FIG. 7 is an enlarged, fragmentary, side-elevation view of the crane boom shown in a folded position.

An additionally important feature of the present invention is that the crane assembly is formed and dimensioned for mounting to vehicle 29 in a manner such that it can be carried by the vehicle on paved city streets without the need for special permits or licenses. Thus, boom 23 is preferably formed for movement between a deployed position, for operation of the crane, and a stored position, for transport of the crane. FIGS. 1 and 7 show the boom of the present invention in a stored position. Boom 23 includes two boom sections 81 and 82 which are pivotally coupled together at pivot pin 83 in order to move the boom sections 82 and 83 between the stored and deployed positions. A hydraulic cylinder 84 is mounted on the boom and coupled to the boom sections through pivotally mounted links 86 and 87. Upon extension of the piston 88 the links cause pivoting of boom section 82 about pivotal pin 83 to the deployed position shown in FIGS. 3, 8 and 9. As will be seen, the boom sections are pivoted to a position at which they are in an end-to-end abutting relation to enable substantial lifting force to be passed through the boom assembly without extreme stress on the pin 83. Once boom 23 is in the deployed position, cable 24 can be paid out over sheave 89 until the hook 26 passes over a sheave 95 at the distal end of second boom section 82.

As best may be seen in FIG. 1, the positioning of mast 38 at the front end of frame assembly 22 and the folding of boom 23 at pivot pin 83 allows the boom to be folded to a stored position in which the boom is positioned over substantially the entire length of the vehicle, without extending beyond the vehicle to a a degree requiring special permits. The height of mast 38 allows the front end or section 82 of the boom to extend over the cab and engine portion of the pick-up truck without obstructing the view, with result that a boom having a substantial length dimension (for example 35 feet) can be carried by a conventional pick-up truck without the need for disassembly of the boom sections and without the need for special permits or licenses for oversized loads.

Additionally, the lateral stabilizing means 61 are pivotaly mounted at 64 so that they can be brought into close proximity to the bed of the vehicle. The transverse upper beams 36 extend out beyond the vehicle sides only slightly so that the leg assemblies can be pivoted around to a position at which they are essentially flush with the sides of the truck.

In operation, the crane assembly of the present invention can be easily stored by the contractor at his plant or storage facility by pivoting support legs 61 to the outward position and locking them into position by diagonal links 72 which include locking pins 75. The hydraulic cylinders 68 in the legs are used to extend leg portions 67 a sufficient distance so as to raise the frame to an elevation which will permit easy removal or mounting of the crane assembly frame in the bed of a pick-up truck. While stored at the contractor's facility apart from the truck, the contractor's pick-up truck is free for other uses.

Transport of the crane assembly to the job site is easily accomplished by backing the pick-up truck in underneath frame 22. Cylinders 68 then lower the crane until it is supported on the bed of the pick-up truck, at which point coupling bars 54 can be placed under the bed and cinched down by cable cinches 56. Legs 67 can be retracted and locking pins 75 released to enable pivoting of the leg assemblies to a position proximate the sides of the truck, as shown in FIG. 1. Usually boom 23 will already be in a folded or stored position, and the crane is ready for transport to the construction site.

At the construction, the truck can be used to position the crane for various lifting tasks. Once positioned, the support legs are again pivoted outwardly and locked in place by pins 75. Legs 67 are lowered until they are brought firmly into contact with the support surface. Boom 23 can be unfolded or deployed by cylinder 84 and then lifted by cylinder 43. The boom can be used to raise substantial weights, with the combination with the stabilizing legs, and the position of the mast on the frame, allowing the weight of the truck to be used as a counter balance to the weight being lifted by the boom. On a three quarter-ton pick-up truck, for example, the crane assembly of the present invention can be used to lift a 6000 pound load at a radius of fourteen feet or a 1200 pound load at thirty five feet.

Once the lifting job is complete, the contractor has the option of removing the boom from the truck for storage at the construction site, returning the boom to his plant for storage at his plant, or mounting the boom to another ballast structure, such as a water tank, for further use at the construction site while the pick-up truck is used for other tasks. This gives the contractor considerably more latitude and flexibility in planning his jobs and allows him to have considerably less investment in lifting equipment.

Figure 10:
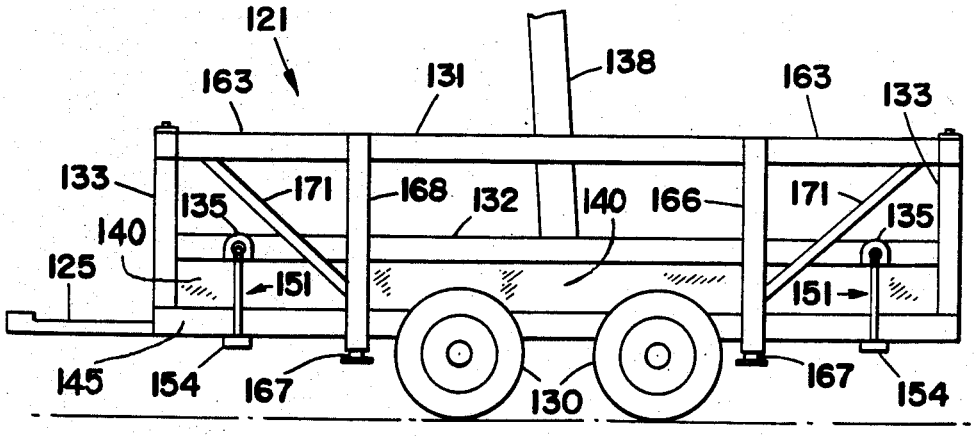
FIG. 10 is a fragmentary, side-elevation view of an alternative embodiment of the crane assembly of the present invention shown mounted to a trailer carrying a water tank.

FIG. 10 illustrates an alternative embodiment of the crane assembly of the present invention with the stabilizing legs shown in stored position. Crane 121 is formed with frame means which is formed for mounting to a trailer, here shown as a trailer having four wheels 130, a trailer bed 135, and a water tank 140 mounted on bed 145. The frame again preferably is formed as a box-like structure with upper and lower longitudinally extending frame members 131 and 132 and connecting vertical frame members 133 and tranverse frame members (not shown). Pivotally mounted to the frame are stabilizing leg assemblies including pivotally attached and transversely deployable members 163 and vertically extending legs 166 with telescopically mounted ground engaging members 167. Diagonal bracing strut 172 extends between leg elements 166 and 163.

In order to releasably couple crane assembly 121 to the trailer, coupling means 151, including coupling bars 154, can be provided. Frame members 132 include coupling flanges 135.

The crane assembly further includes a centrally mounted mast which is preferably mounted to pivot a full 360° about a vertical axis. This can be accomplished most easily by providing a gear train (not shown) instead of the cable assembly described with the embodiment of FIGS. 1–9, which is used to produce about 180° of angular displacement of the mast. The boom assembly is not illustrated but can take the same form as shown and described above.

As is true for the pick-up truck mounted embodiment, the crane assembly of FIG. 10 can be removed from the trailer to allow the trailer to function as a conventional water tank trailer or the weight of the water in tank 140 can be used as ballast in combination with the stabilizing legs to provide a highly versatile construction crane. Since the trailer can be easily moved by hitch assembly 125, the contractor can position and reposition the trailer at the building site as needed. Similarly, the crane can be stored at the contractor's yard apart from the traler when not needed at the site or left on the trailer at the site.

What is claimed is:

1. In a crane assembly including frame means formed and dimensioned for mounting to a pick-up truck having a truck bed with upstanding side walls mounted on a truck frame, a lifting boom assembly movably mounted on said frame means for movement in a plurality of directions relative thereto, movable cable lifting means mounted on said lifting boom assembly coupling means releasably coupling said frame means to said pick-up truck, and crane support means carried by said frame means and movable between a stored position and a deployed position, wherein the improvement in said crane assembly comprises:

said frame means being dimensioned for and received between said upstanding side walls of said truck bed;

said coupling means including at least one coupling bar means extending transversely of said bed beneath an underneath side of said truck frame and terminating in bar ends proximate opposite sides of said truck bed, linkage means coupled between each of said bar ends and said frame means, cinching means provided in at least one of said linkage means for cinhcing of said bar means up against said underneath side of said truck frame, and at least one of said linkage means being removably coupled to said bar means to enable removal of said crane assembly from said pick-up truck;

said crane support means being carried by said frame means for movement into and out of engagement with a support surface on which the pick-up truck is supported to stabilized said crane assembly when coupled to said pick-up truck, said crane support means further being adapted for stand-alone support of said crane assembly when the latter is detached from said pick-up truck, said crane support means includes adjustable means to place said crane assembly in position to be selectively coupled and uncoupled to said pick-up truck; and

2. The crane assembly as defined in claim 1 wherein, said bar means includes:

(a) a first bar disposed transversely to engage said underside of said truck frame, each of said bar ends of said first bar being removably connected by said linkage means to said frame means; and (b) a second bar disposed transversely to engage said underside of said truck frame at a spaced apart distance from said first bar, each of said bar ends of said second bar being removably connected by said linkage means to said frame means.

3. The crane assembly as defined in claim 2 wherein, said first bar and said second bar are aligned in substantially parallel relation to one another and are coupled to said frame means by said linkage means proximate opposite ends of said frame means.

4. The crane assembly as defined in claim 1 wherein, said frame means is supported on an upwardly facing surface of said truck bed intermediate said upstanding side walls, said frame means extends upwardly proximate an inside of both of said side walls to positions above said side walls, and said frame means extends outwardly above both said side walls to positions outside said side walls, and said linkage means is coupled to said frame means at said positions outside said side walls.

* * * * *